United States Patent [19]

Benthake et al.

[11] Patent Number: 4,893,557

[45] Date of Patent: Jan. 16, 1990

[54] COUPLING DEVICE FOR AN ADJUSTER WHEEL

[75] Inventors: Norbert Benthake, Schöppenstedt; Hans-Jürgen Kusch, Neckargemünd, both of Fed. Rep. of Germany

[73] Assignee: Heidelberger Druckmaschinen AG, Heidelberg, Fed. Rep. of Germany

[21] Appl. No.: 841,675

[22] Filed: Mar. 19, 1986

Related U.S. Application Data

[63] Continuation of Ser. No. 722,995, Apr. 15, 1985, abandoned, which is a continuation of Ser. No. 500,774, Jun. 3, 1983, abandoned.

[30] Foreign Application Priority Data

Jun. 3, 1982 [DE] Fed. Rep. of Germany ..... 3220872

[51] Int. Cl.[4] ..... B41F 13/00

[52] U.S. Cl. ..... 101/141; 74/625; 318/2

[58] Field of Search ..... 101/132, 136, 141, 142; 74/625; 318/2

[56] References Cited

U.S. PATENT DOCUMENTS

| | | | |
|---|---|---|---|
| 2,724,289 | 11/1955 | Wight | 74/625 |
| 3,292,453 | 12/1966 | Recknagel | 101/132 |
| 3,992,991 | 11/1976 | Koch | 101/132 |

*Primary Examiner*—David B. Wiecking

*Attorney, Agent, or Firm*—Herbert L. Lerner; Laurence A. Greenberg

[57] ABSTRACT

Coupling device for an adjuster wheel to manually start up printing machine functions, including an adjuster wheel shaft adjustably displaceable axially in stages for bringing an adjuster wheel mounted on the shaft and into and out of operative connection with drive gearing of a printing machine, shift sense, in response to axuation of the adjuster wheel shaft, in a first stage, preventing switching-on of a drive motor for the printing machine, and a clutch device, in a second step of axial adjustment of the adjuster wheel shaft, forming the operative connection of the adjuster wheel with the drive gearing of the printing machine.

2 Claims, 2 Drawing Sheets

COUPLING DEVICE FOR AN ADJUSTER WHEEL

This application is a continuation, of application Ser. No. 722,995 ,filed Apr. 15, 1985, now abandoned, which is a continuation of Ser. No. 500,774 ; filed 6/3/83 and now abandoned.

BACKGROUND OF THE INVENTION

The invention relates to a coupling device or clutch for an adjuster wheel, and more particularly, to such an device for use in small offset presses, for manually starting-up machine functions.

Adjuster wheel of the aforementioned general type have various areas of application in the entire field of mechanical engineering. They are also used, amongst others, in small offset presses wherein, due to manual actuation of the impression cylinders and other machine functions, a numger of activities preparatory to the automatic printing process can be performed, such as the clamping-on of printing plates, for example. The limination of various malfunctions, for example due to paper snarl-up or jamming, is also performed in this manner.

For reasons of safety, such adjuster wheels and the corresponding coupling mechanism, respectively, must meet various requirements. Thus, for example, assurance must be provided that the adjuster wheel will be disengaged when the printing machine is running and, furthermore, that a driving or entrainer connection between the adjuster wheel and the printing machine drive is possible only when the printing machine is stationary.

SUMMARY OF THE INVENTION

An object of the invention is to provide a coupling device for an adjuster wheel which has a relatively simple and therefore economical construction and, while complying with the safety requirements, affords, nevertheless, quick and safe engagement and disengagement, while being relatively simple to operate without any additional manipulations.

With the foregoing and other objects in view, there is provided, in accordance with the invention, a coupling device for an adjuster wheel to manually start up printing machine functions, comprising an adjuster wheel shaft adjustably displaceable axially in stages for bringing an adjuster wheel mounted on the shaft into and out of operative connection with drive gearing of a printing machine, shift means, in response to axial actuation of the adjuster wheel shaft, in a first stage, preventing switching-on of a drive motor for the printing machine, and a clutch device, in a second step of axial adjustment of the adjuster wheel shaft, forming the operative connection of the adjuster wheel with the drive gearing of the printing machine.

As a result of the use of several adjustment or shifting stages, which are well coordinated with one another, such an adjuster wheel affords a rapid, but not controlled or unintentional conversion or shiftover from manual operation to machine operation or vice versa.

In accordance with another feature of the invention, stop means are provided effective after each of the two adjustment stages as stage limitation elements, the stop means being overridden in each case by simultaneously turning the adjuster wheel.

In accordance with a further of the invention, the shift cylinder disposed on the adjuster wheel shaft so as to be fixed against turning relative thereto and against axial displacement relative thereto, the shift cylinder being formed with a peripherally surrounding groove for actuating a limit switch operative associated therewith, and a bracket with which the groove cooperates simultaneously so as to serve as an axiliary locking device for an engaged end position of the shift cylinder.

In accordance with an additional feature of the invention, the shift cylinder is formed with a thrust face having entrainer tangs thereat, the thrust face engaging a stationary locking layer, the locking lever being pivotable by turning the adjuster wheel.

In accordance with an added feature of the invention, a coupling ring is axially displaceably disposed on the adjuster wheel shaft and fixed thereon against turning relative thereto, the coupling ring being supported under spring pressure at a side wall of the printing machine, the adjuster wheel shaft being withdrawable and turnable about the longitudinal axis thereof so as to positively connect the coupling ring to a coupling claw of a bushing forming part of the clutch device and being disposed on the adjuster wheel shaft so as to be freely turnable thereon, an effective connection of the coupling device to the drive gearing of the printing machine being via the bushing.

In accordance with yet another feature of the invention, the adjuster wheel is pressable inwardly so as to axially displace the adjuster wheel shaft over an adjustment travel distance thereof for both the adjustment stages for disengaging the coupling device as well as the adjuster whee.

Other features which are considered as characteristic for the invention are set forth in the appended claims.

DESCRIPTION OF THE PREFERRED EMBODIMENT

Although the invention is illustrated and described herein as embodied in coupling device for an adjuster wheel, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
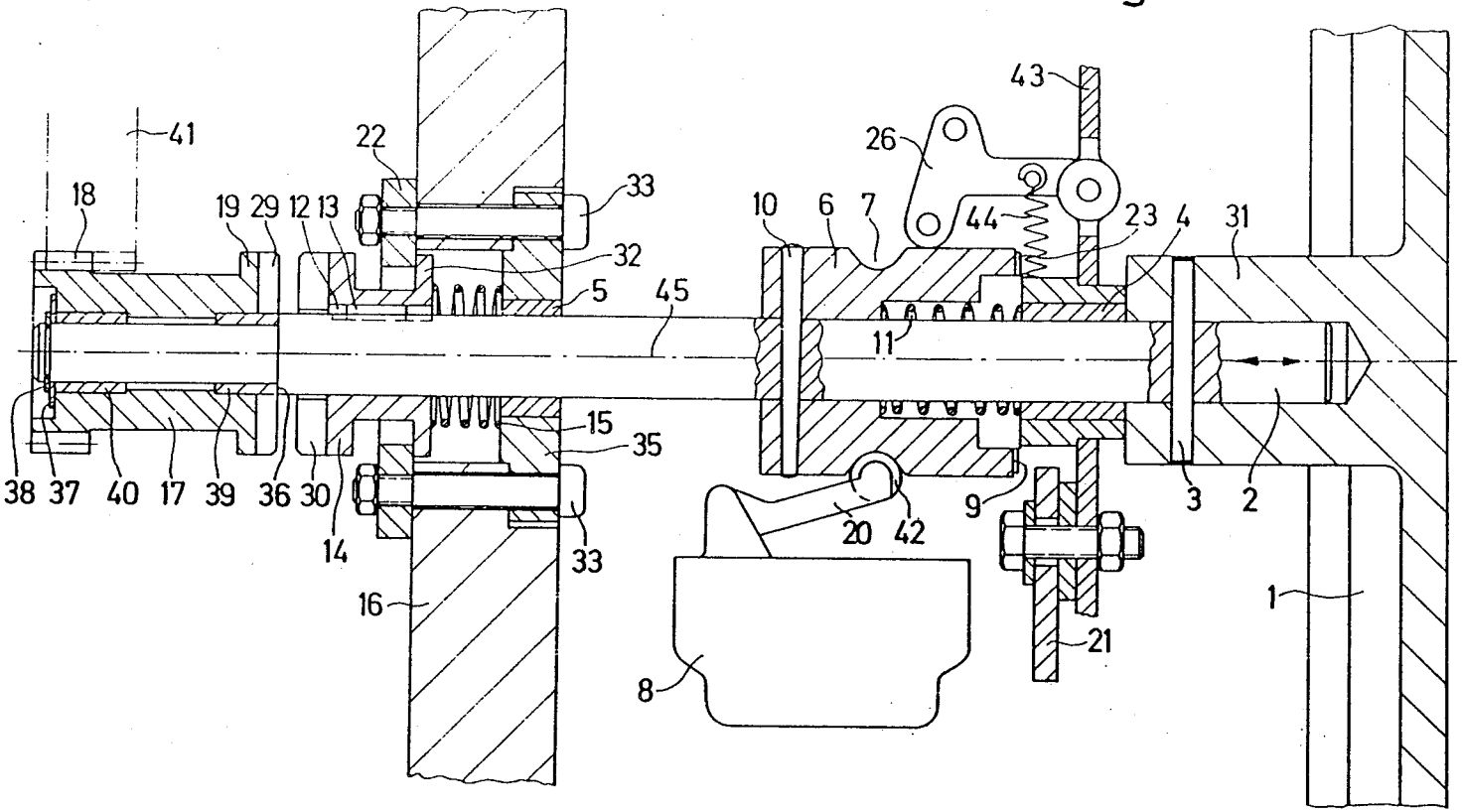
FIG. 1 is a longitudinal sectional view of the coupling device or clutch according to the invention in disengaged condition.

Referring now to the drawing and first, particularly to FIG. 1 thereof, there is shown an adjuster wheel 1 disposed on a corresponding adjuster wheel shaft 2 so that, by means of a pinned connection 3, the adjuster wheel can neither move axially nor turn. The adjuster wheel shaft 2 itself has two bearing locations 4, 5, wherein it is mounted so as to be turnable and axially displaceable.

As seen serially, starting from the adjuster wheel 1, there are arranged on the adjuster wheel shaft 2 initially, a shift cylinder 6 formed with a surrounding peripheral groove 7 for tripping a limit switch 8 and having an end thrust face 9. The shift cylinder 6 is connected by means of a pin 10 to the adjuster wheel shaft 2 so as to be nondisplaceable in axial direction and fixed against turning relative to the shaft 2. Furthermore, a compression spring 11 is provided for positioning the adjuster wheel 1 in the disengaged position, which causes the spring-loaded stop of a neck 31 of the adjuster wheel 1 to act upon a bearing member 4. Moreover, disposed on the adjuster wheel shaft 2 is an axially displaceable coupling ring 14 which, however, due to a groove 12 formed thereon, prevents turning of a feather key 13 received in the groove 12 . The coupling ring 14 is supported by a shoulder 32 thereof via a further compression spring 15 on a ring 22 which is attached to the side wall 16 by means of fastening screws 33. The fastening screws 33 also hold a bearing ring 35 carrying the bearing 5 in the position thereof.

Finally, the adjuster wheel shaft 2 carries a bushing 17 which is axially fixed on the adjuster wheel shaft 2 by a stop 36, a disc 37 and a retaining ring 38, but which is turnable relative to the shaft 2 on bearings 39 and 40. The bushing 17 is connected at one end via a gearwheel 18 to the drive gearing 41 of the printing machine and is formed as a coupling claw 19 on the opposite end thereof.

Operation

Figure 2:
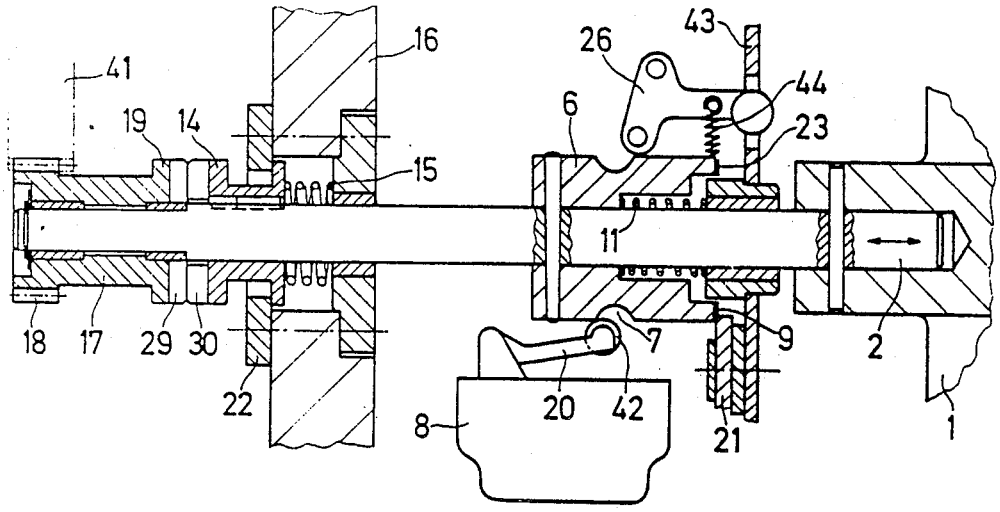
FIG. 2 is another view like that of FIG. 1 slightly reduced in scale showing the coupling device in a first shift stage.

The mode of operation of the device upon actuation of the adjuster wheel 1 is as follows:

Initially, the adjuster wheel 1 together with the adjuster wheel shaft 2 is pulled out slightly by the operator, as shown in FIG. 2. A roller 42 of a trip lever 20 is thus moved out of the groove 7 of the shift cylinder 6 and the thus tripped limit switch 8 prevents switching-on of the drive motor. This therefore means that the printing machine can only be driven when the adjuster wheel 1 is disengaged.

The adjuster wheel shaft 2 can only be pulled out, however, until the thrust face 9 of the shift cylinder 6 comes up against a pivotal locking lever 21. The coupling ring 14 is held in the position thereof by the compression spring 15, the position being determined, as mentioned hereinbefore by the end stop thereof at a ring 22 attached to the side wall 16.

The bushing 17 is pulled in the direction of the coupling ring 14 due to the axial displacement of the adjuster wheel shaft 2, but does not yet engage.

The locking lever 21 is turnable about a center line 50 of its supporting bolt 49. The entrainer tangs 23 disposed at spaced intervals over the periphery of the thrust face 9 of the shift cylinder 6 pivot the locking lever 21 about the pivot axis 50 thereof when the shift cylinder 6 is turned into the position thereof shown in FIG. 2, so that this locking lever 21 provides no stop or resistance any longer to the thrust face 9 of the shift cylinder 6 and, accordingly, can pull the adjuster wheel shaft 2 farther out (towards the right- hand side) from the side wall 16 of the machine.

Figure 3:
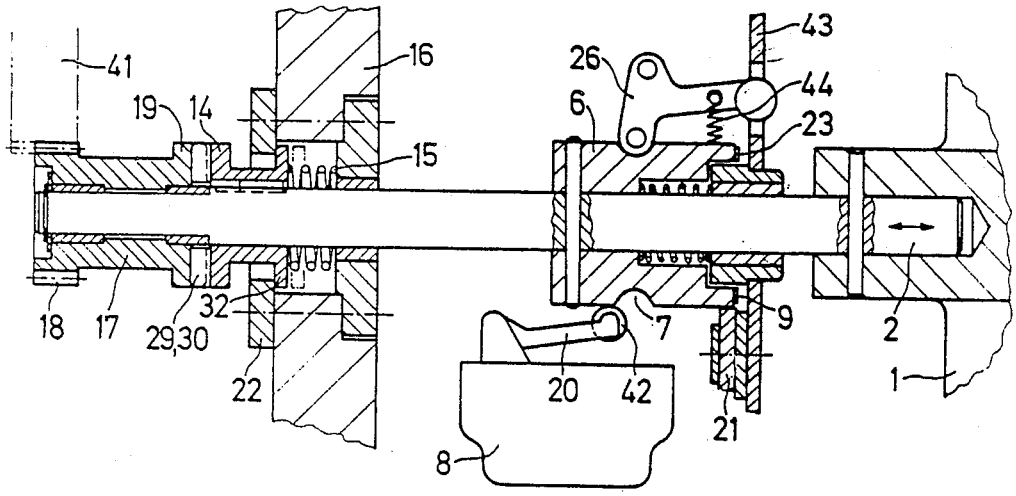
FIG. 3 is another view like that of FIG. 2 showing the coupling device in engaged condition.

Therefore, as a result of subsequent turning of the adjuster wheel 1, the locking lever 21 is swung to the side by projecting entrainer tangs 23 of the shift cylinder 6 which are disposed on the thrust face 9 of the shift cylinder 6 so that the adjuster wheel shaft 2 can then be pulled out farther until a bracket 26 which is rotatably held in the bearing plate 43 and serves as an auxiliary locking device engages in the groove 7 of the shift cylinder 6. This engaging action of the bracket 26 is assisted by a tension spring 44. Due to the aforedescribed further withdrawal of the adjuster wheel shaft 2, the bushing 17, by means of webs 29 of the coupling claw 19 thereof, presses against webs 30 of the coupling ring 14 and displaces the latter against the action of the opposing force of the compression spring 15, as indicated in FIG. 3 by broken line. By turning the adjuster wheel 1 again, the two coupling parts 14 and 19, which are under spring pressure, rest within one another, thus establishing a positive connection between the adjuster wheel shaft 2 and the printing machine drive 41. The shoulder 32 of the coupling ring 14 again engages the end face of the ring 22 which is attached to the side wall 16. To facilitate the engagement, the webs 29 and 30 of the coupling parts 14 and 19 can be chamfered.

The adjuster wheel 1 is disengaged by simply pressing it in . It is pressed in over the distance of adjustment travel of the two shifting stages with the result that the position shown in FIG. 1 is again attained.

There are claimed:

1. In a printing machine having a drive system including drive gearing, a coupling device for an adjuster wheel manually turnable for starting up printing machine functions, comprising an adjuster wheel shaft having an adjuster wheel at one end thereof and a gear wheel at the other end thereof, said adjuster wheel shaft being adjustably displaceable axially in two stages for bringing the adjuster wheel into and out of operative connection via the gear wheel with the drive gearing of the printing machine, shift means, in response to axial displacement of said adjuster wheel shaft, in one of the two stages, preventing switching on of the drive system for the printing machine, a clutch device, in response to a further axial displacement of said adjuster wheel shaft, in the other of the two stages operatively connecting the adjuster wheel with the drive gearing of the printing machine, first and second stop means engageable with said shift means and effective after each of said two adjustment stages, respectively, as stage limitation elements for limiting further axial displacement of said adjuster wheel shaft, and means actuable by turning the adjuster wheel for disengaging and overriding said first stop means.

2. Coupling device according to claim 1, wherein said shift means comprise a shift cylinder disposed on said adjuster wheel shaft so as to be fixed against turning relative thereto and against axial displacement relative thereto, said shift cylinder being formed with a peripherally surrounding groove for actuating a limit switch operatively associated therewith, said second stop means comprise a bracket cooperatively engaging in said groove and forming therewith an auxiliary locking device for an engaged end position of said shift cylinder, said shift cylinder being formed with a thrust face having entrainer tangs thereat, said first stop means comprising a locking lever engageable with said thrust face, said locking lever being pivotable by turning the adjuster wheel, and wherein said clutch device comprises a coupling ring axially displaceably disposed on said adjuster wheel shaft and fixed thereon against turning relative thereto, said coupling ring being supported under spring pressure at a side wall of the printing machine, said adjuster wheel shaft being withdrawable and turnable about the longitudinal axis thereof so as to positively connect said coupling ring to a coupling claw of a bushing forming part of said clutch device and being disposed on said adjuster wheel shaft so as to be freely turnable thereon, an effective connection of the coupling device to the drive gearing of the printing machine being via said bushing.

* * * * *